US005743529A

United States Patent [19]

Haynes

[11] Patent Number: 5,743,529

[45] Date of Patent: Apr. 28, 1998

[54] BOARD GAME TO TEACH STEPS IN HOME CONSTRUCTION

[76] Inventor: Edward L. Haynes, 62 Back Bay Rd., Bowling Green, Ohio 43402

[21] Appl. No.: 800,647

[22] Filed: Feb. 4, 1997

[51] Int. Cl.[6] ..... A63F 3/00

[52] U.S. Cl. ..... 273/256; 434/107

[58] Field of Search ..... 434/107; 273/256, 273/243, 278

[56] References Cited

U.S. PATENT DOCUMENTS

| | | | |
|---|---|---|---|
| 4,076,249 | 2/1978 | Sneathen, Jr. . | |
| 4,179,128 | 12/1979 | Zelazny | 273/256 |
| 4,382,602 | 5/1983 | Cusick et al. . | |
| 4,426,084 | 1/1984 | Michel | 273/256 |
| 4,666,162 | 5/1987 | Campbell | 273/256 |
| 5,080,369 | 1/1992 | Mongno . | |
| 5,207,792 | 5/1993 | Anderson . | |
| 5,456,473 | 10/1995 | Whitney | 273/256 |
| 5,683,087 | 11/1997 | Henshaw et al. | 273/256 |

*Primary Examiner*—Paul J. Hirsch
*Attorney, Agent, or Firm*—Marshall & Melhorn

[57] ABSTRACT

A board game for teaching a family interested in purchasing a home about the construction steps involved in building a dwelling. Each player is provided with a game piece representing a family interested in building a home. A game board is provided which has a sequence of spaces around the perimeter indicating a particular step of construction and an amount representing the cost of construction. A separate playing path provided through the middle of the game board has angularly steps indicated thereon. A money station is provided on the board representing sources of funds for home down payments. One or more bank draw spaces are provided in the corners of the rectangular playing board to provide extra money to the players as the game progresses.

16 Claims, 8 Drawing Sheets

BOARD GAME TO TEACH STEPS IN HOME CONSTRUCTION

BACKGROUND OF THE INVENTION

Field of the Invention

The present invention relates to a teaching and recreational board game. More particularly, the present invention relates to a board game that teaches the process of constructing a home to players or families interested in constructing a dwelling. The game familiarizes the players with the financial and construction principles involved in the building process.

DESCRIPTION OF THE PRIOR ART

There are many educational games that teach or simulate various subjects. However out of these wide variety of games, applicant is only familiar with four games which relate to real estate development or the construction of a home.

U.S. Pat. No. 4,076,249 to Sneathen, Jr. discloses a game played on a board marked as a residential sub-division. Markers are moved about the board by the players in response to the play of dice, with the players representing buyers, developers and sellers of residential and commercial lots marked on the board. The board is marked with a layout of a continuous path of blocks representing a route along several joining streets with individually numbered building lots marked adjacent each block of the route. The game includes markers for representing each player's position on a block of the route, miniature houses to represent buildings constructed by a player on a lot adjacent to his marker position, play money which may be borrowed by a player from a bank card, cards representing engineering, sewer and water, paving, building and sales and rentals contracts, together with two sets of penalty or reward cards.

While the Sneathen, Jr. game does teach steps of construction, they are steps of construction related to a sub-division and not a residential home.

U.S. Pat. No. 4,382,602 to Cusick, et al discloses a real estate game for amusement and educational purposes. A game board is provided and two tracks are provided around the game board. The outer track is called the prospecting circuit, and in the real estate business corresponds to marketing one's services by trying to find perspective real estate listings and buyers. An inner track is also provided, called the buyer's circuit, upon which listings are placed. This inner track is also for buyers, represented by game pieces, one for each player which move around the board. The number of spaces each player moves is determined by spinning a wheel until one of the buyers lands on one of the players listing. The primary object of the Cusick invention is to provide a game apparatus for teaching the principles of selling, including teaching various methods of prospecting and the relative sales thereof. Thus, the Cusick game apparatus also does not teach residential construction.

U.S. Pat. No. 5,080,369 to Mongno discloses a board game simulating the construction of a dwelling. The game has a board with a sequence of spaces including free spaces, builder/bank spaces, inspection sticker spaces, chance spaces, question spaces, penalty spaces, and a game closing space. Players move three-dimensional game tokens representing homes of different styles around the board. Player progress through the construction process is tracked on a rotary card holder of plot playing cards, a card representing a stage of construction when the previous stage has been completed. The first player to complete all stages and land on the closing space wins the game. It is felt that the Mongno game emphasis on inspections and plot plans may be confusing to the average home owner interested in the construction process.

U.S. Pat. No. 5,207,792 to Anderson discloses a combination construction board game and advertising medium which includes a board having a first series of spaces over which playing pieces are moved to acquire financing and to make selections with respect to housing plans and types of construction which are selected and are purchased using a first set of cards, and a second series of spaces where players pay off construction loans and furnish the homes being constructed with amenities selected from a second set of cards which designate a variety of fixtures, furniture and/or home improvements or amenities where at least some of the cards displaying amenities carry advertising of the actual manufacturer of the product or service.

The object of the Anderson game is stated to provide a game board which is directed to selecting a house and thereafter obtaining proper building and financing for the house and for obtaining furnishing for the house with regard to specific rooms and other amenities. It does not stress the individual construction steps, nor provide a teaching medium in this regard. Thus, those skilled in the art continued to search for a game which could teach the average family the steps in construction of a residential dwelling in an interesting and entertaining manner.

SUMMARY OF THE INVENTION

A board game for teaching a family interested in purchasing a home about the construction steps involved in building a dwelling. Each player is provided with a game piece representing a family interested in building a home. A game board is provided which has a plurality of spaces around the perimeter indicating particular steps of the construction process, and an amount representing the cost of the construction step. A separate playing path provided proximate the middle of the game board, but connected to the outer or perimeter path, has setback or "consequences" steps indicated thereon. A money station is provided on the board representing sources of funds for home down payments. One or more bank draw spaces are provided in the corners of the rectangular playing board to provide extra money to the players as the game progresses.

A die means or random number generator is provided, and the first player to roll eight starts the game. No purchase of any kind can take place on the first trip around the board, but the players may make their visit to the money station space in the same order they complete their first trip around the board. A player must next land on and purchase a lot space representing the lot that he is building a house on. After this he must land on all twenty-five inspection spaces, and he will receive a small flag as each inspection is completed.

Once the players receive their money from the money station space they actively get involved in building the home. Financial gains and losses are incurred by paying for the various stages of construction, as well as by landing on penalty spaces. The players progress through the construction process is indicated on a house shaped playing piece, or construction frame, with spaces to accept the twenty-five flags representing each of the construction steps. The first player to fill his playing piece with flags wins.

Therefore it is an object of the present invention to provide a board game which teaches the various steps of constructing a residential dwelling to a family interested in constructing the same in an entertaining manner.

Further objects and advantages of the present invention will be apparent from the following description and appended claims, reference being made to the accompanying drawings forming a part of the specification, wherein like reference characters designate corresponding parts in the several views.

Figure 1:
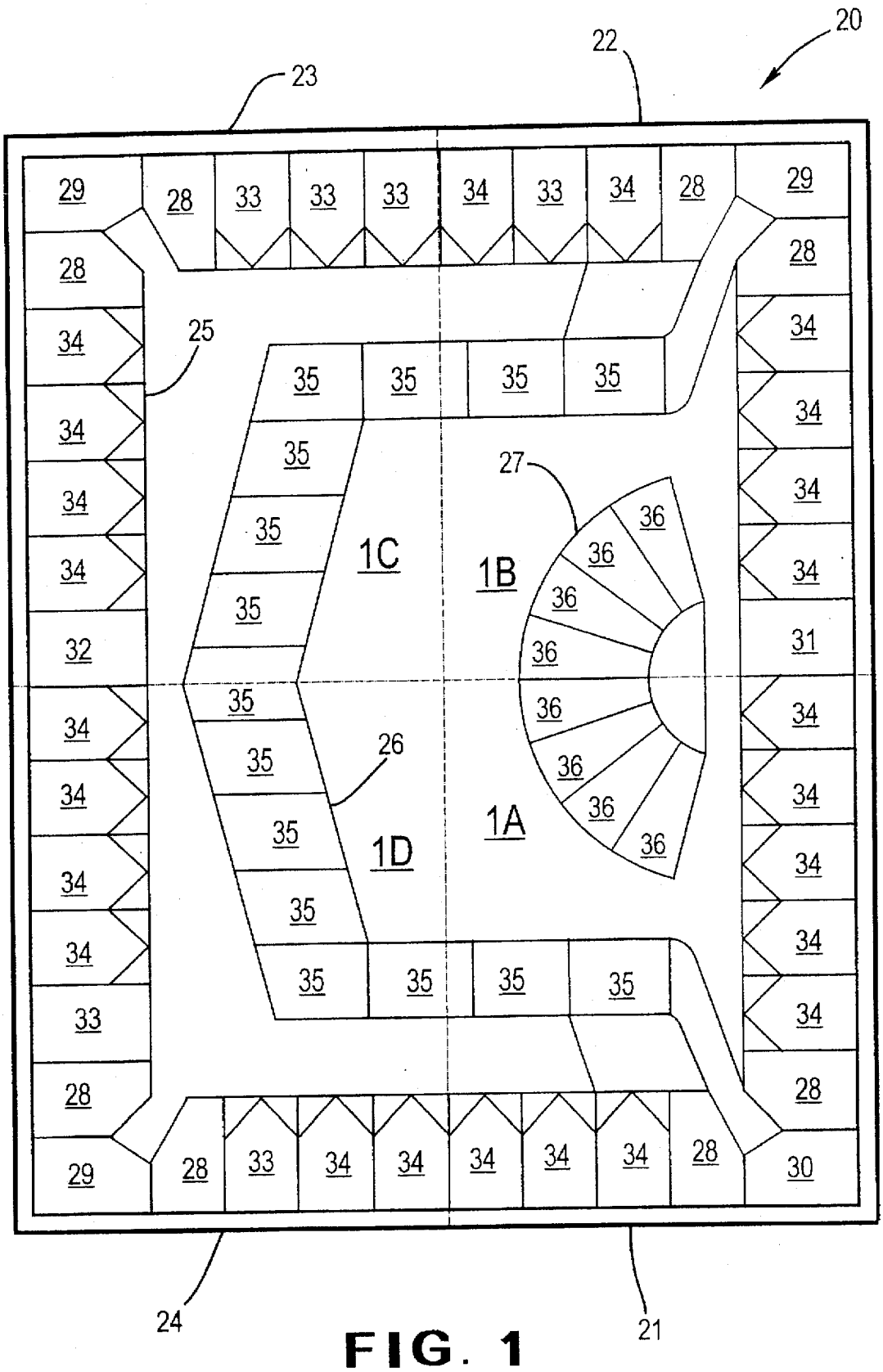
FIG. 1 is an overall plan view of a game board utilized in the present invention.
Figure 1A:
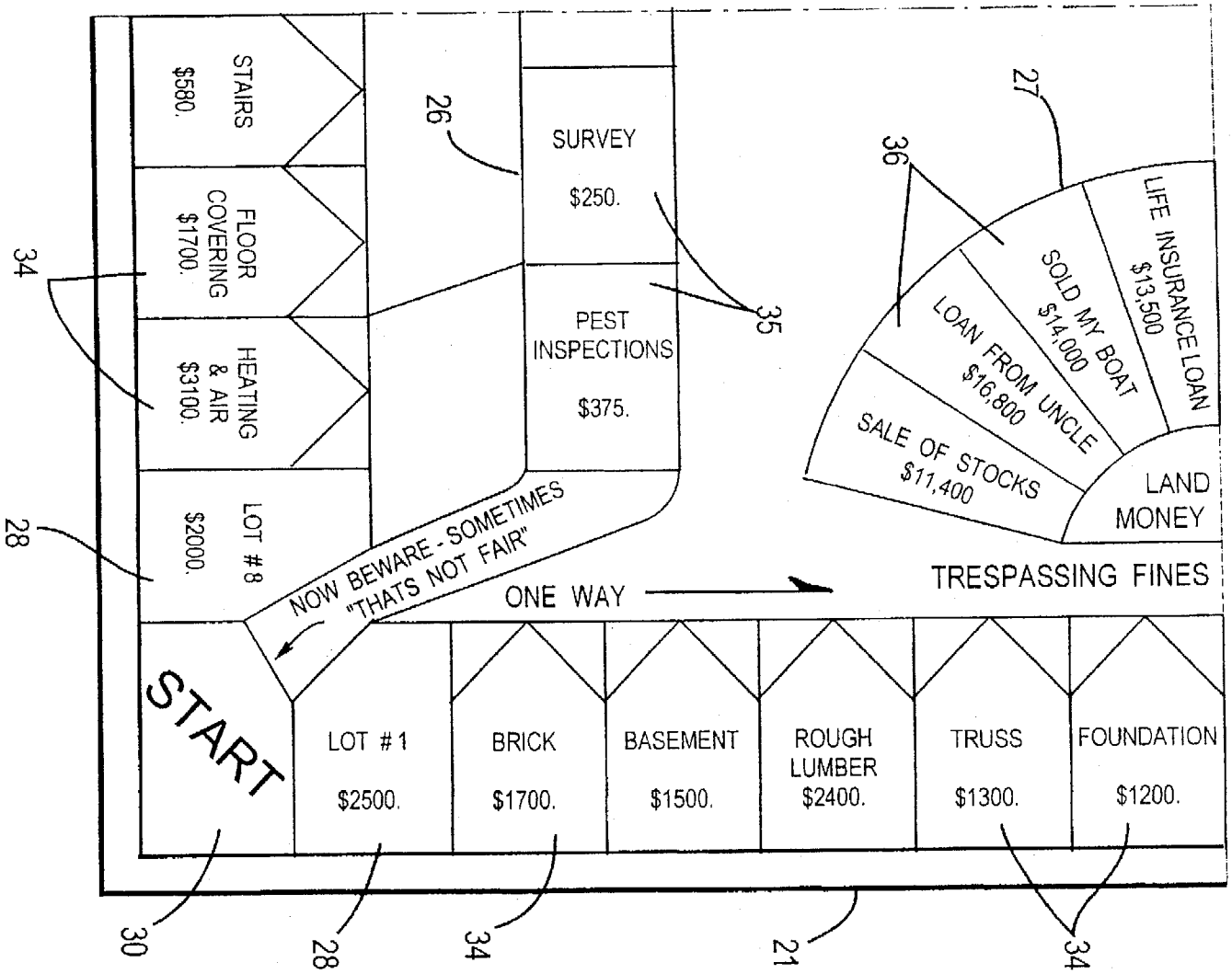
FIGS. 1*a*–1*d* are each partial plan views of the game board used in the present invention, each of FIGS. 1*a*–1*d* showing a quadrant of the full game board.
Figure 1B:
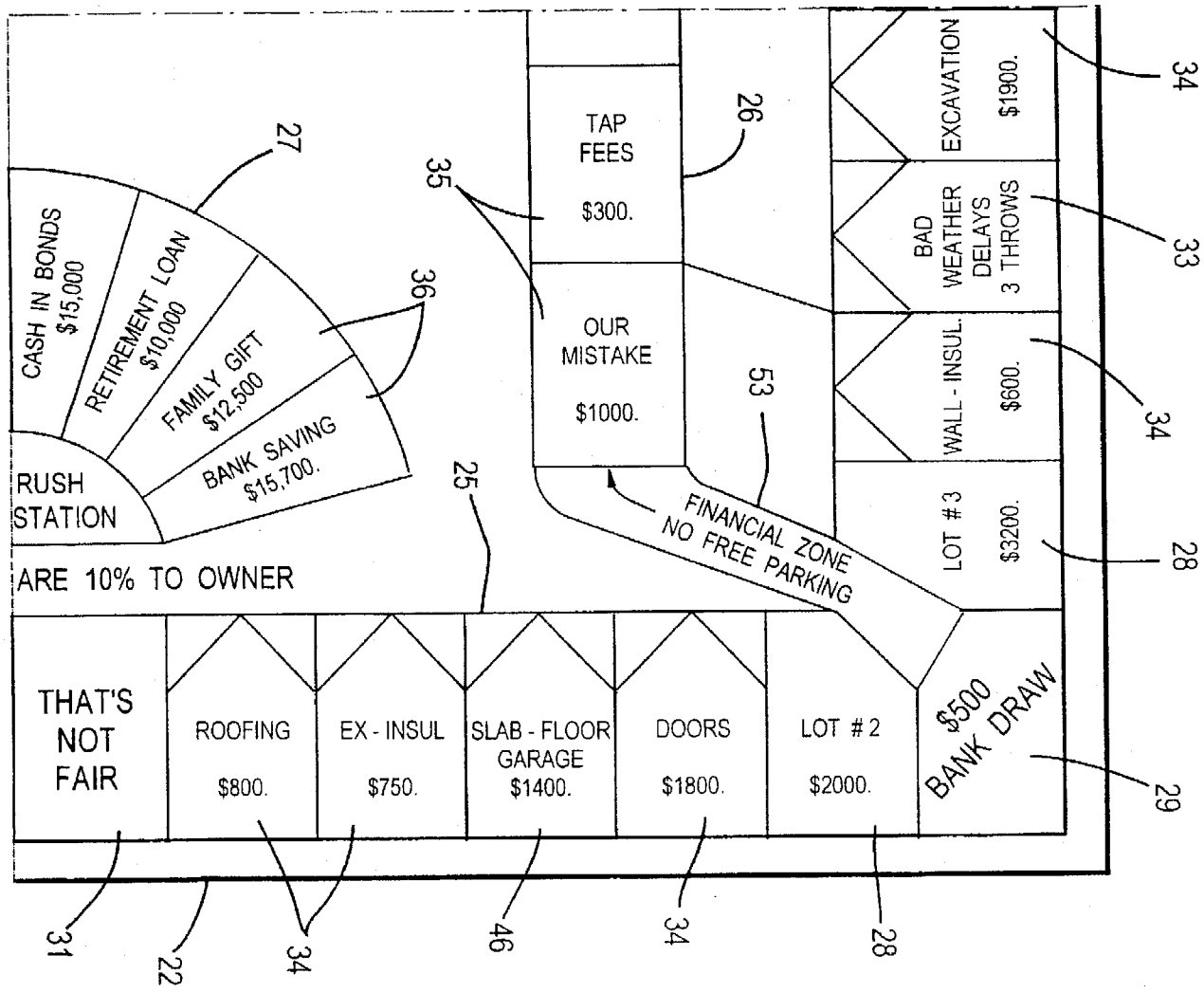
Figure 1C:
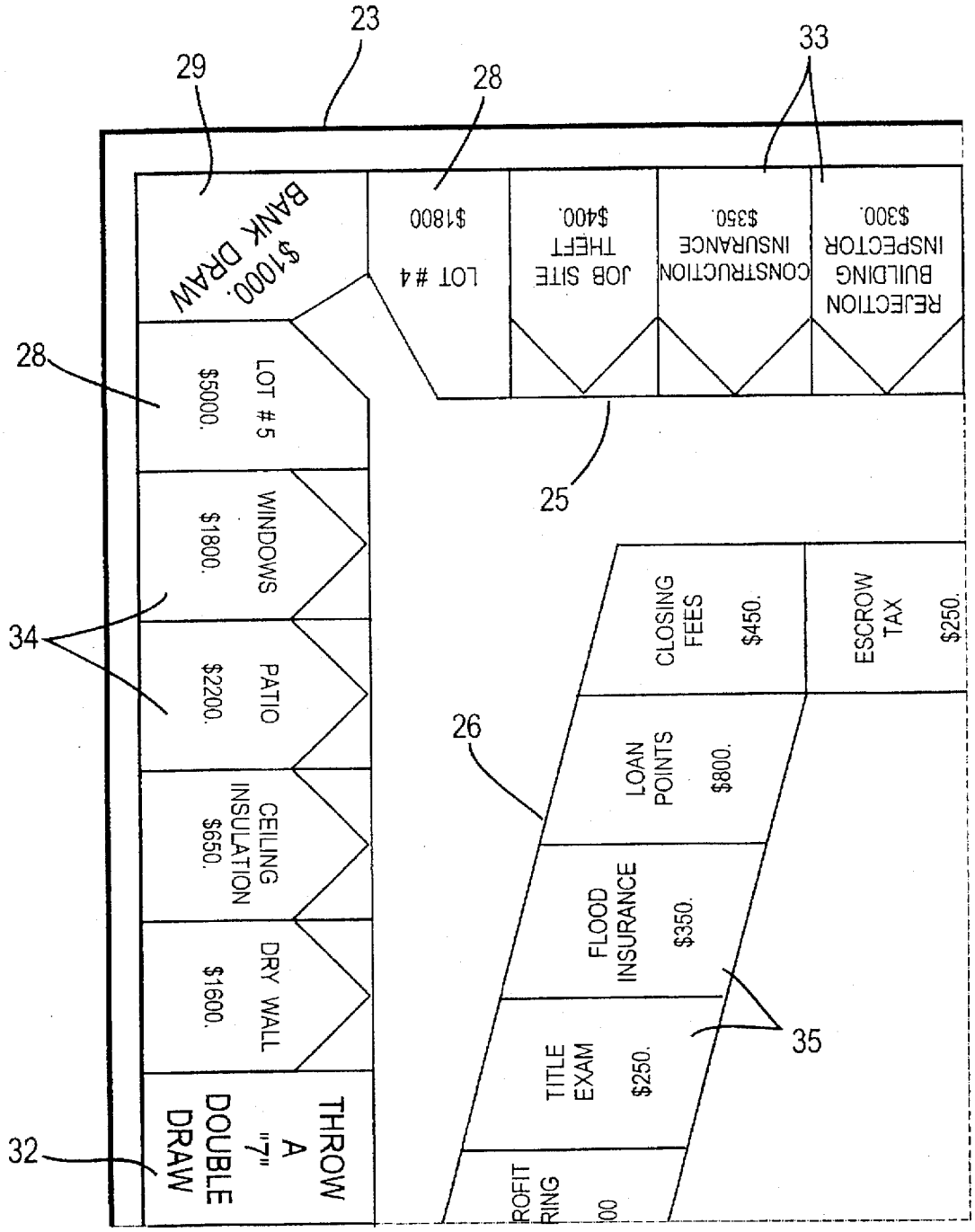
Figure 1D:
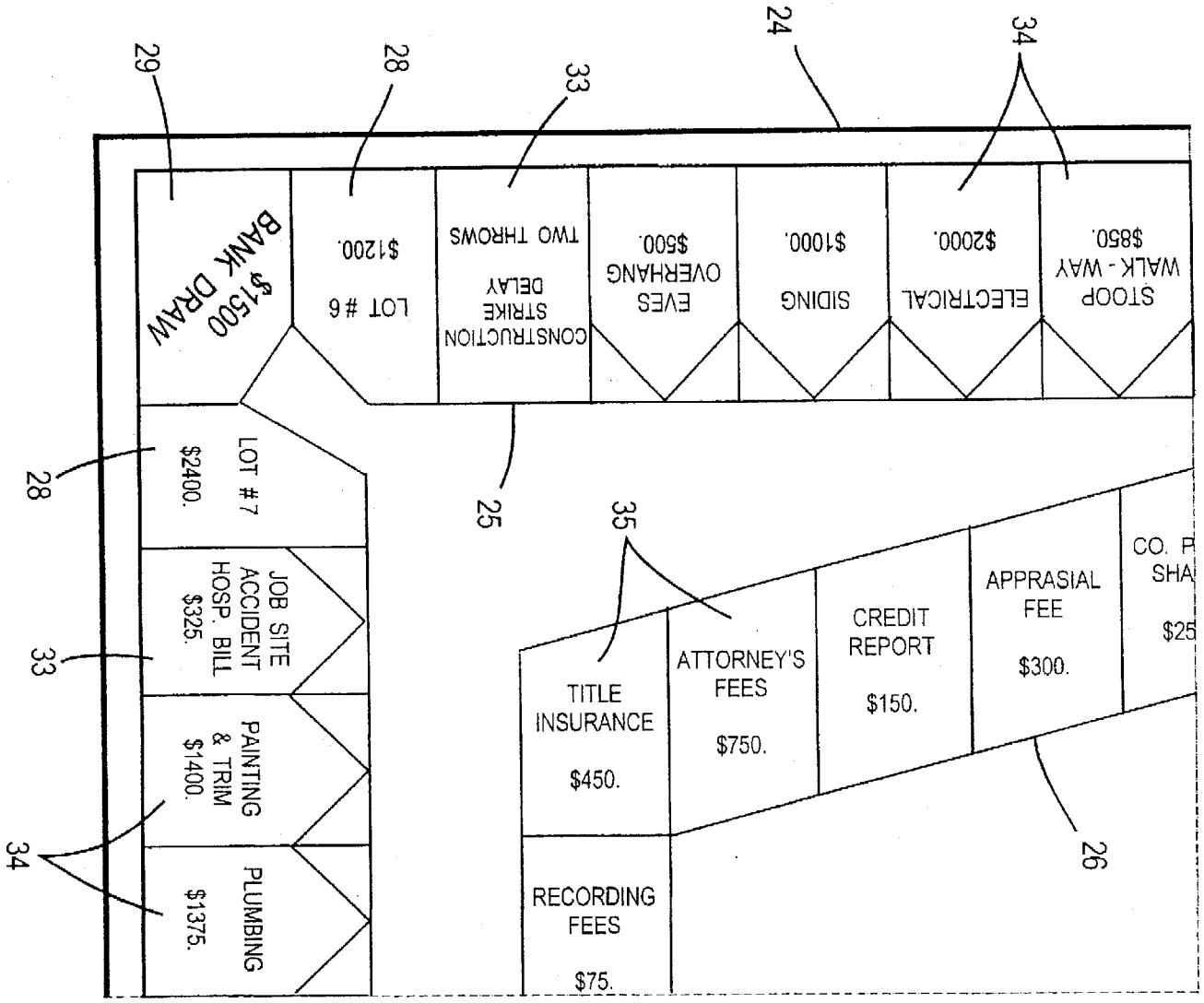

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description and not of limitation.

DESCRIPTION OF THE PREFERRED EMBODIMENT

In the preferred embodiment of the present invention, a game board, generally designated by the numeral 20, is provided having a first quadrant 21 a second quadrant 22 a third quadrant 23 and a fourth quadrant 24. The four quadrants (21–24) are shown in more detail in the FIGS. 1*a* through 1*d* respectively. The game board includes an outer or parametrical playing path 25, and an inner playing path 26 connected at two corners of the game board with the outer playing path. A money station indicia 27 is also provided for purposes to be explained. The board contains eight lot spaces 28 indicating which lots the purchasers can obtain, and the purchase price. Three bank draw spaces 29 are also provided, whereby the players if they land on these spaces, can obtain additional financing for the construction of their dwelling. Also provided on the board is a "that's not fair" space 31, and a "throw a double seven" space 32.

There are six stumbling blocks or spaces 33. The remainder of the positions on the outer or peripheral playing path are the construction blocks 34. A listing of the stumbling blocks is as follows:

| | | |
|---|---|---|
| 1. | $400 | Job Site Theft |
| 2. | $325 | Job Site Accident (hospital bills) |
| 3. | $300 | Building rejection inspector |
| 4. | $350 | Construction insurance |
| 5. | Bad weather - delays - 3 throws | |
| 6. | Construction strike delays - 2 throws - delay 2 throws | |

A listing of the construction blocks 34 is as follows:

1. Lot
2. Excavation
3. Foundation
4. Slab floor basement
5. Rough Lumber
6. Truss
7. Roofing
8. Exterior insulation
9. Wall Insulation
10. Insulation
11. Brick
12. Siding
13. Dry wall
14. Electrical
15. Plumbing
16. Garage slab
17. Windows
18. Doors
19. Heating & Air
20. Eves & overhang
21. Painting & trim
22. Stoop & sidewalk
23. Floor covering
24. Stairs
25. Porch & patio On the inner playing path 26 are fifteen "setbacks" or "consequences" positions 35 as follows:

| | | |
|---|---|---|
| 1. | $1000 | Refund - our mistake |
| 2. | $300 | Tap fee |
| 3. | $250 | Escrow |
| 4. | $450 | Closing fee |
| 5. | $800 | Loan points |
| 6. | $350 | Flood insurance |
| 7. | $250 | Title examination |
| 8. | $2500 | Profit sharing |
| 9. | $300 | Appraisal fee |
| 10. | $150 | Credit report |
| 11. | $750 | Attorney's fee |
| 12. | $450 | Title insurance |
| 13. | $75 | Recording fees |
| 14. | $250 | Survey fee |
| 15. | $375 | Pest inspection |

Lastly, the money station indicia 27 contains eight "capital" spaces 36. These eight positions supply the following amount of capital to the players as listed below:

| | | |
|---|---|---|
| 1. | $11,400 | Sale of stock |
| 2. | $16,800 | Loan from Uncle |
| 3. | $14,000 | Sold my boat |

-continued

| | | |
|---|---|---|
| 4. | $13,500 | Life insurance loan |
| 5. | $15,000 | Cash in bonds |
| 6. | $10,000 | Retirement loan |
| 7. | $12,500 | Family gift |
| 8. | $15,700 | Bank savings |

Figure 2:
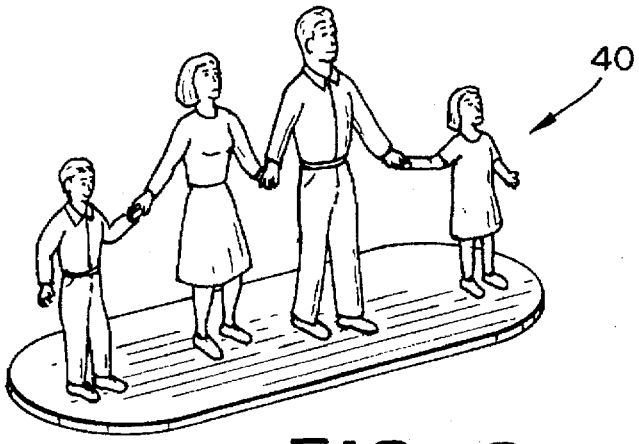
FIG. 2 is a perspective view of a representative family playing piece which may be used by a player in connection with the game board shown in FIGS. 1*a*–1*d;*
Figure 3:
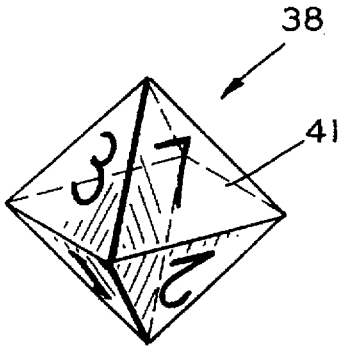
FIG. 3 is a perspective view of a random number generating means.
Figure 4:
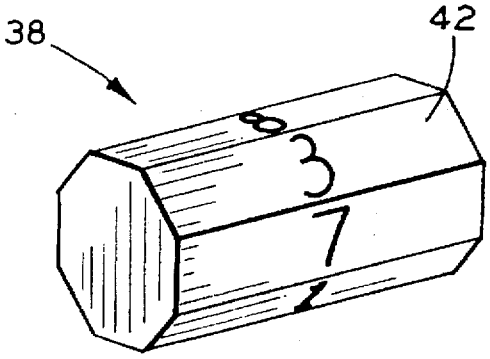
FIG. 4 is a perspective view showing another embodiment of a random number generating means.
Figure 10:
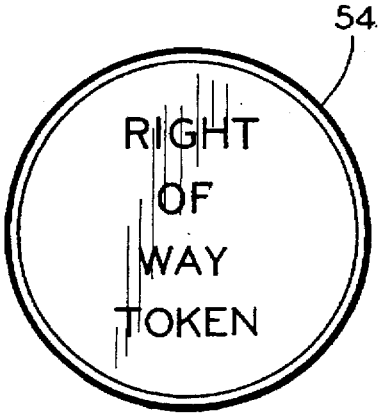
FIG. 10 is a plan view of a right of way token used in the play of the game embodying the present invention.
Figure 11:
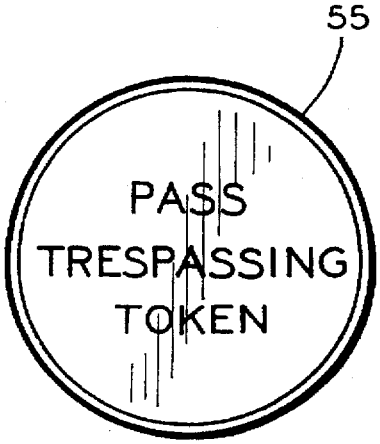
FIG. 11 is a plan view of a pass trespassing token used in playing the game embodying the present invention.
Figure 5:
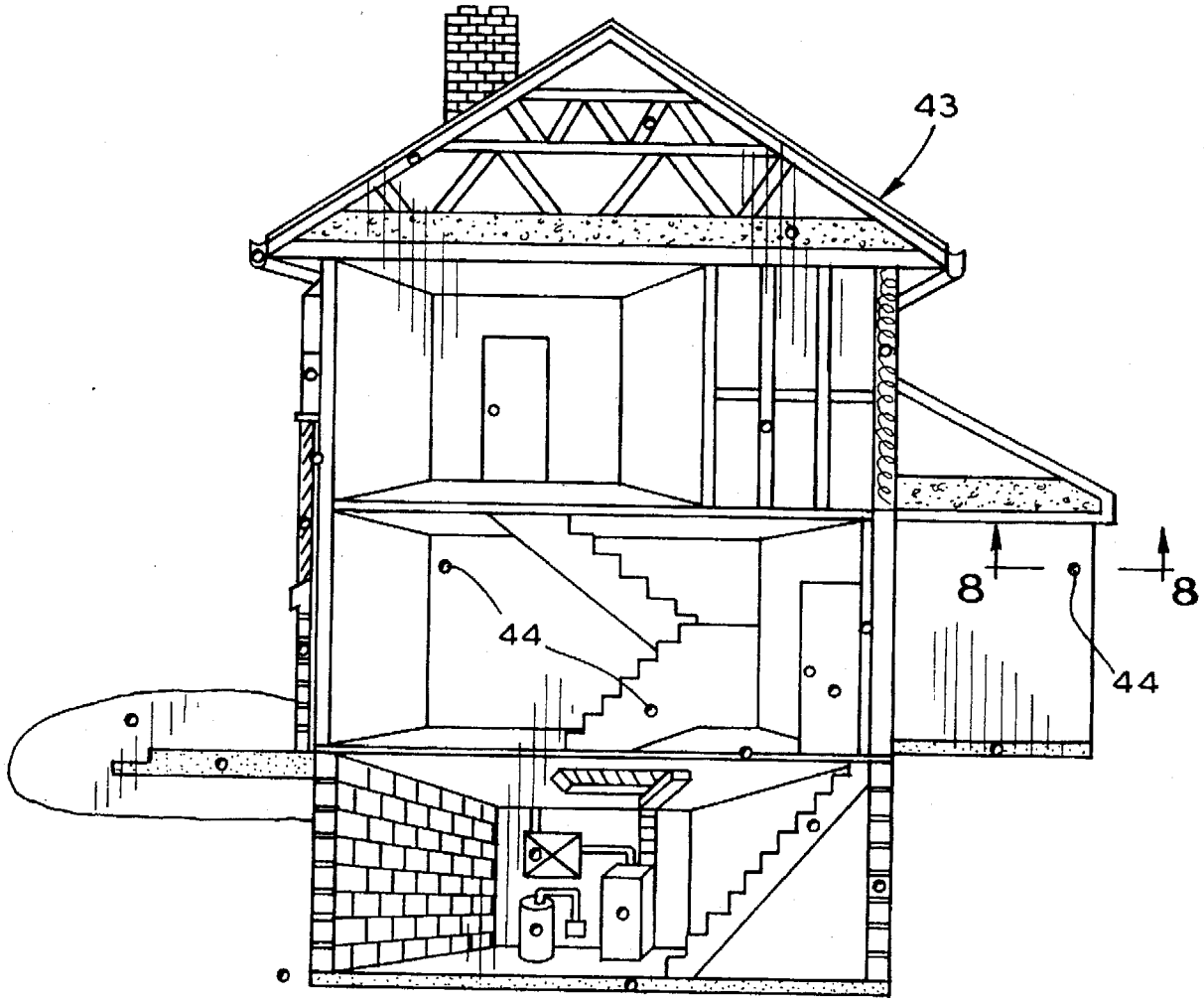
FIG. 5 is a plan view of a construction frame used in the game embodying the present invention.

Referring now to FIGS. 2–5, at the beginning of the game each player will be issued playing piece 40, such as illustrated in FIG. 2, and a construction frame 43, such as illustrated in FIG. 5. In the preferred embodiment of the invention, the playing piece 40 is three dimensional as illustrated, and has members thereon representative of a typical family. The playing pieces may be distinguished by having different number of family members and/or pets thereon so that the playing pieces may be easily distinguished. Different colors may also be used. The playing pieces may also be made two-dimensional if desired and be well within the scope of the present invention.

Figure 7:
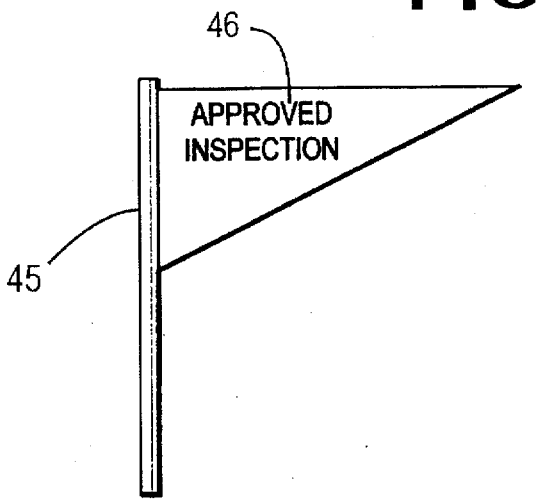
FIG. 7 is an elevational view of a construction completion flag used in the game of the present invention.
Figure 8:
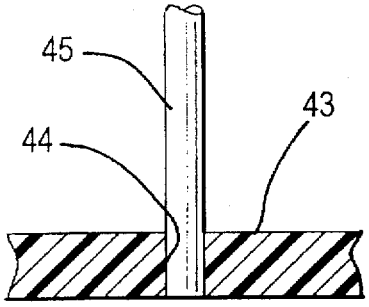
FIG. 8 is a partial sectional view, taken in the direction of the arrows, along the section line 8—8 of FIG. 5.
Figure 9:
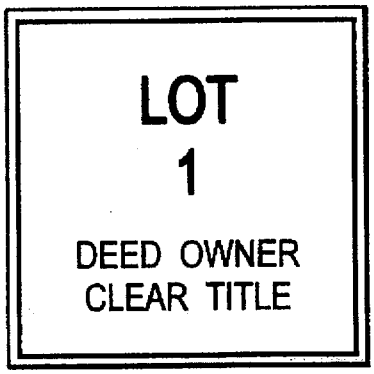
FIG. 9 is a property owner deed used in the game of the present invention.

The construction frame 43 is preferably made of a foam backed illustration board of approximately ¼" thickness which will have provided thereon a graphic illustration of a home, and be provided with twenty-five holes 44 corresponding to the twenty-five construction block spaces 34 on the playing board 20. As shown in FIGS. 7 and 8 each of the holes 44 in the construction frame 43 is adapted to receive a construction completion flag 45 corresponding to one of the construction block spaces 34. Generally the indicia 46 on the construction completion flag 45 will match a like indicia appearing in one of the construction block spaces 34 on the game board 20.

In play, each of the players will place their game piece 40 on the start block 30. The players will then "roll" the random number generator 38, such as eight sided octagon 41, or eight sided barrel 42, in succession until one of the players receives an "eight". That player may then roll again and start advancing along the outer playing path 25 in a counterclockwise direction. The other players will continue trying to roll an "eight" to determine their order of play, and as each player in succession rolls an "eight", he too may start around the game board.

Figure 6:
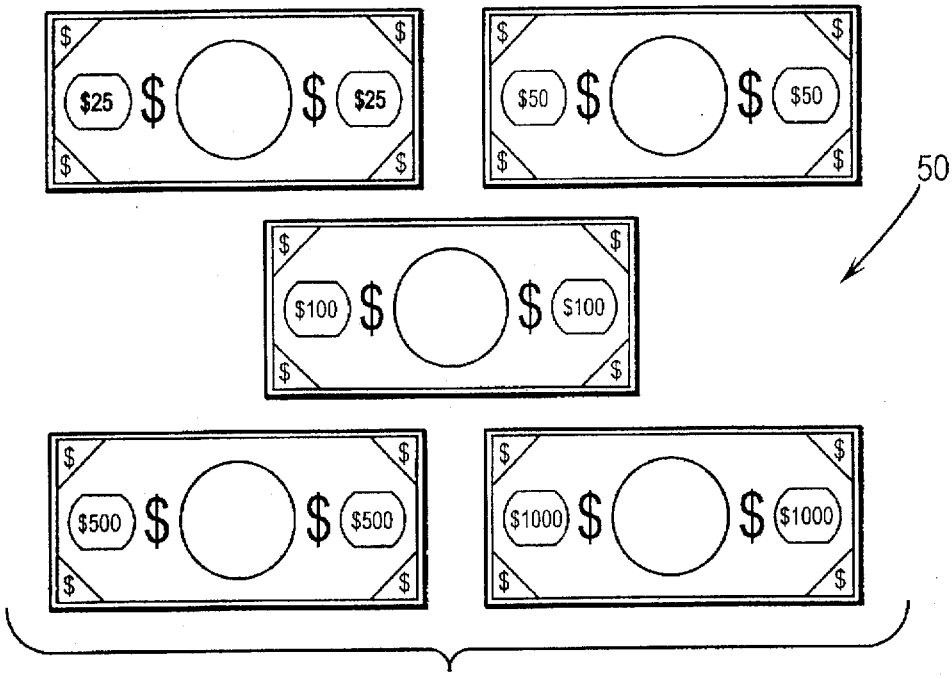
FIG. 6 is a plan view showing the simulated currency used in the game embodying the present invention.

The player will, on the first turn around the board, just proceed from space to space by the roll of the dice, not paying attention to the indicia 46 on any of the spaces 28–34. The player's object is to be the first to reach the start space. An exact roll of the dice is not necessary to land on "start", but the first player, and the other players in succession, will not pass start on their first turn around the board. Instead, as each player reaches "start", they will make a selection from one of the "capital"spaces 36, and will receive that amount of money from the bank in the simulated currency 50 in various denominations such as shown in FIG. 6. It can be seen that the capital spaces vary in monetary value from $10,000 up to $16,800. Thus, there is monetary advantage to being the first player around the board. Once selection has been made from one of the capital spaces 36 that category is closed to the other players.

The next stage of the game is now entered. As the respective players obtain their capital contribution from the "capital" spaces 36 as they reach the start block 30, their next object is to buy a lot to build on. Only the eight lot spaces previously described come into play at this time and the players will continue to roll the random generator number means 38 in seriatem, and go around the board until they land on one of the lot spaces 28. Then they will pay back to the bank enough of the simulated currency 50 to purchase the lot.

Once a lot is purchased, if any player lands on that particular lot in subsequent travels around the board, they must pay the owner of that lot 10% of the value indicated as a trespassing fee. Once a player has reached this stage of the game, his object is to land on all of the construction block spaces 34, obtain the respective construction flags 45, and place them in the respective holes 44 in the construction frame 43. The first player to have placed all of the construction flags 45 in the construction 43 wins the game.

However, there are many perils in the travels around the board that come into play once a player reaches the point of attempting to land on all of the construction blocks 34.

For example, there are eight stumbling blocks 33 which will require the player to pay the bank the amount indicated thereon. If the player lands on too many of these spaces he will run out of cash or "capital", and be out of the game. The player has limited opportunities to get additional capital by landing on the bank draw spaces 29 and may not have obtained enough capital to survive the stumbling blocks.

Also, there is a single "that's not fair" space 31. Once he lands on this space, he must proceed to the financial zone space 53 and travel along the entire inner playing path 26 in a counterclockwise direction back to the start space. This occurs without him landing on the $500 bank draw space, and involves substantial penalties unless he rolls the numeral one and lands on the "our mistake" space, in which the case the bank pays him a thousand dollars and he goes back to "that's not fair" space and continues the game.

Special consideration may be given for the rolling of the number "eight" on the random generator means 38. At any time after a player has received the amount of capital indicated on the capital spaces 36 and he rolls an eight he may roll again after transacting business on the space he is on.

If he rolls two "eights" in a row, a player may receive a free building block of his choice.

If a player rolls three "eights" in a row, he has hit the "jackpot" and may receive any three construction blocks at no cost.

An option, when the player rolls three "eights" in a row, is to elect to choose the "right of way token" 54. This token allows a player, for the rest of the game to land on any of the stumbling blocks 33 with no penalties or fees to pay.

Another option when a player rolls three "eights" in a row is to elect to receive "trespassing pass" token 46. This token allows you to land on any lot without paying the owner a trespassing fee. There is only one qualification—the right of way token 45 and the trespassing pass token 46 do not apply to the "that's not fair" block 31. If you land there you still must pay the fees.

A very lucky block for the player to land on is the "throw a double seven draw" block 32. When a player lands on this block, the initial seven would have already taken him to the $1500 bank draw block, but if he throws another seven, not only will he advance to that block but collect double the money, or $3000 for his "good luck".

It can be understood that many variations of the present game are possible by varying the number of money stationed indicia 27, lot spaces 28, bank draw spaces 29, that's not fair spaces 31, throw a double seven space 32, stumbling block spaces 33, construction block spaces 34, consequence spaces 35, and capital spaces 36. All such variations well within the scope of the present invention.

Also, many variations in the rules for the game may be provided and be well within the scope of the present invention. For example, the rules may specify that if you run short of cash during the game you may forfeit a block, or building blocks, for the cash you need. The player may turn in his flag for a refund of one half the purchase price. It may be provided the players may or may not exchange lots or construction blocks, or may or may not borrow cash from one another. Normally in the preferred embodiment the only time a player may interact with another player in exchanging property is when all the lots are purchased and there is a player with no construction lot. In that case the player owning the most lots must sell the player owning no lots one of his lots at a profit ten percent over his cost. The buyer will then select a lot and occupy that lot.

Another option may be to provide a "duel". When two players land on the same block anywhere they will roll a "duel", with the random number generator 38. This means that they both must roll again. The player with the lowest number then must move forward to "that's no fair" space, and continue the game from this position in his next turn. The player rolling the highest number in the duel will advance to that number indicated on the random number generator.

Thus, it can be seen that there are many variations of this game all designed to teach the person or family wanting to construct a house the necessary steps by the means of a novel board game and method of play thereof.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A game for teaching the construction of a residential dwelling in an entertaining manner, said game comprising:

a) a game board having a plurality of playing spaces arranged in a first or parametrical playing path around the perimeter of the game board, and a second or inner playing path proximate the middle of the game board but connected to said outer playing path, and a money station;

b) a simulated currency;

c) a random number generator means;

d) a plurality of visually distinguishable game pieces representing families wishing to construct a home, one for each player, said game pieces marking the location of a player on the game board;

e) a plurality of construction frames, one for each player, each of said construction frames having spaces to accept a predetermined number of construction flags; and f) a plurality of construction flags obtained by players as they proceed around said game board, the first player to obtain said predetermined number of constructions flags, and thus fill all the holes in said construction frame, being the winner of the game.

2. The game defined in claim 1, wherein said plurality of spaces include a "start" space.

3. The game defined in claim 2, wherein said plurality of spaces include "lot" spaces.

4. The game defined in claim 3, wherein said plurality of playing spaces include "bank draw" spaces.

5. The game defined in claim 4, wherein said plurality of playing spaces include a "throw a double seven" space.

6. The game defined in claim 5, wherein said plurality of playing spaces include "stumbling block" spaces.

7. The game defined in claim 6, wherein said plurality of playing spaces include "construction block" spaces.

8. The game defined in claim 7, wherein said plurality of spaces contained in said inner playing path include "consequences" spaces.

9. The game defined in claim 8, wherein said plurality of spaces in said outer playing path are contiguously arranged in a hollow square.

10. The game defined in claim 9, wherein said random number generator is an eight sided sphere.

11. The game defined in claim 9, wherein said random number generator is an eight sided cylinder.

12. A method for playing a game in order to teach the steps involved in the construction of a residential dwelling, said method comprising the steps of:

a) a plurality of players moving a plurality of visually distinguishable game pieces, one for each player, around a game board having a plurality of playing spaces arranged in an outer parametrical playing path and an inner playing path, the playing spaces arranged around the outer parametrical path including at least one "that's not fair" space and at least a plurality of spaces labeled as "construction block" spaces, and the spaces on the inner playing path containing at least spaces labeled as "consequences" spaces, each player moving one of said game tokens according to numbers generated by a random number generator;

b) each player making payments with simulated currency for each of said "construction block" spaces involved in the process of constructing a dwelling and receiving a construction flag in return for the purchase of each "construction block" space;

c) each player who lands on the "that's not fair space" provided in the outer parametrical playing path needing to proceed through the "consequences" spaces in said inner playing path and pay the penalties associated with each space;

d) each player inserting said construction flags as they are obtained into a construction frame having holes sufficient to receive all of said construction flags; and e) one of said players first collecting all of said construction flags.

13. The method defined in claim 12, wherein said outer parametrical playing path also includes lot spaces and said method includes the step of each player having to first purchase one of the lots for the amount indicated thereon before proceeding to obtain said construction blocks.

14. The method defined in claim 13, wherein said game board further comprises a money station having capital spaces indicated thereon, and wherein said method further comprises the step of each player proceeding once around the outer parametrical path on said game board and the player first proceeding entirely around the board and reaching a start position having his selection of the amount of currency indicated in any one of the capital spaces.

15. The method defined in claim 14, wherein said playing spaces in said outer parametrical path include one or more spaces labeled as "bank draw" spaces, and said method further comprising the step of each player who lands on a "bank draw" space drawing the amount of simulated currency indicated thereon.

16. The method defined in claim 15, wherein said playing spaces in said outer parametrical path include one or more spaces labeled as "stumbling blocks" , and said method further comprising the step of each player who moves a playing piece to one of said "stumbling blocks" paying the penalty amount of currency listed thereon.

* * * * *